313-414 SR
1/31/84 OR 4,429,252

United States Patent [19]
Vieland et al.
[11] 4,429,252
[45] Jan. 31, 1984

[54] COLOR PICTURE TUBE HAVING AN EXPANDED FOCUS LENS TYPE INLINE ELECTRON GUN WITH IMPROVED STATIC CONVERGENCE

[75] Inventors: Leon J. Vieland, Princeton; Roger C. Alig, Princeton Junction, both of N.J.

[73] Assignee: RCA Corporation, New York, N.Y.

[21] Appl. No.: 348,023

[22] Filed: Feb. 11, 1982

[51] Int. Cl.[3] ..... H01J 29/51; H01J 29/46

[52] U.S. Cl. ..... 313/414; 313/412; 313/458; 313/460

[58] Field of Search ..... 313/414, 412, 458, 460

[56] References Cited

U.S. PATENT DOCUMENTS

| | | | |
|---|---|---|---|
| 3,873,879 | 3/1975 | Hughes | 315/13 |
| 4,275,332 | 6/1981 | Ashizaki et al. | 313/414 |
| 4,317,065 | 2/1982 | Hughes | 313/414 |
| 4,370,592 | 1/1983 | Hughes et al. | 313/414 |
| 4,374,342 | 2/1983 | Say | 313/414 |

*Primary Examiner*—Eugene R. Laroche
*Assistant Examiner*—Vincent De Luca
*Attorney, Agent, or Firm*—Eugene M. Whitacre; Dennis H. Irlbeck

[57] ABSTRACT

An improvement is made in a color picture tube having an inline electron gun for generating and directing a plurality of electron beams along coplanar paths toward a screen of the tube. The gun includes a main focus lens for focusing the electron beams which is formed by two spaced electrodes. Each electrode includes a portion having a plurality of apertures therein equal to the number of electron beams. Each electrode also includes a peripheral rim. The peripheral rims of the two electrodes face each other and the apertured portion of each electrode is within a recess set back from the rim. The improvement comprises the depths of the apertures in the electrodes being equal to the thickness of material of the electrodes. This aperture structure permits greater penetration of the electrostatic lines of the main focus lens into the electrodes behind the apertured portions of the electrodes. This penetration of electrostatic lines provides a converging field for off-axis electron beams.

3 Claims, 8 Drawing Figures

COLOR PICTURE TUBE HAVING AN EXPANDED FOCUS LENS TYPE INLINE ELECTRON GUN WITH IMPROVED STATIC CONVERGENCE

BACKGROUND OF THE INVENTION

The present invention relates to color picture tubes having inline electron guns, and particularly to an improvement in such guns having expanded lenses for obtaining increased static convergence.

An inline electron gun is one designed to generate or initiate preferably three electron beams in a common plane and direct those beams along convergent paths to a point or small area of convergence near the tube screen. In one type of inline electron gun, such as that shown in U.S. Pat. No. 3,873,879, issued to Hughes on Mar. 25, 1975, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced relative to each other thereby providing a severe limitation on focus lens design.

An improved electron gun having an expanded focus lens to overcome the aforementioned focus lens design limitation is disclosed in copending U.S. patent application Ser. No. 201,691, filed Oct. 29, 1980 by Hughes et al. which is assigned to the same assignee as the present application. In this electron gun, the main focus lens is formed by two spaced electrodes. Each electrode includes a plurality of apertures therein equal to the number of electron beams. Each electrode also includes a peripheral rim with the peripheral rims of the two electrodes facing each other. The apertured portion of each electrode is located within a recess set back from the rim. Each aperture of each focus electrode includes a peripheral extrusion which extends into the electrode away from the opposing electrode. Static convergence of the two outer electron beams with the center electron beam is accomplished by forming a wider peripheral rim on one focus electrode than on the other focus electrode.

It has been found that the foregoing static convergence means only provides about forty percent of the static convergence required. Therefore, there is a need for a static convergence scheme that will provide greater static convergence. Furthermore, the use of differently shaped parts for electron gun construction, especially where the parts are not easily distinguishable by visual inspection, is undesirable both because of additional cost and because of the possibility of assembly errors.

SUMMARY OF THE INVENTION

An improvement is made in a color picture tube having an inline electron gun for generating and directing a plurality of electron beams along coplanar paths toward a screen of the tube. The gun includes a main focus lens for focusing the electron beams which is formed by two spaced electrodes. Each electrode includes a portion having a plurality of apertures therein equal to the number of electron beams. Each electrode also includes a peripheral rim. The peripheral rims of the two electrodes face each other and the apertured portion of each electrode is within a recess set back from the rim. The improvement comprises the depths of the apertures in the electrodes being equal to the thickness of material of the electrodes.

The foregoing structure permits greater penetration of the electrostatic lines of the main focus lens into the electrodes behind the apertured portions of the electrodes. This penetration of electrostatic lines provides a converging field for off-axis electron beams.

DETAILED DESCRIPTION OF THE PREFERRED EMBODIMENT

Figure 1:
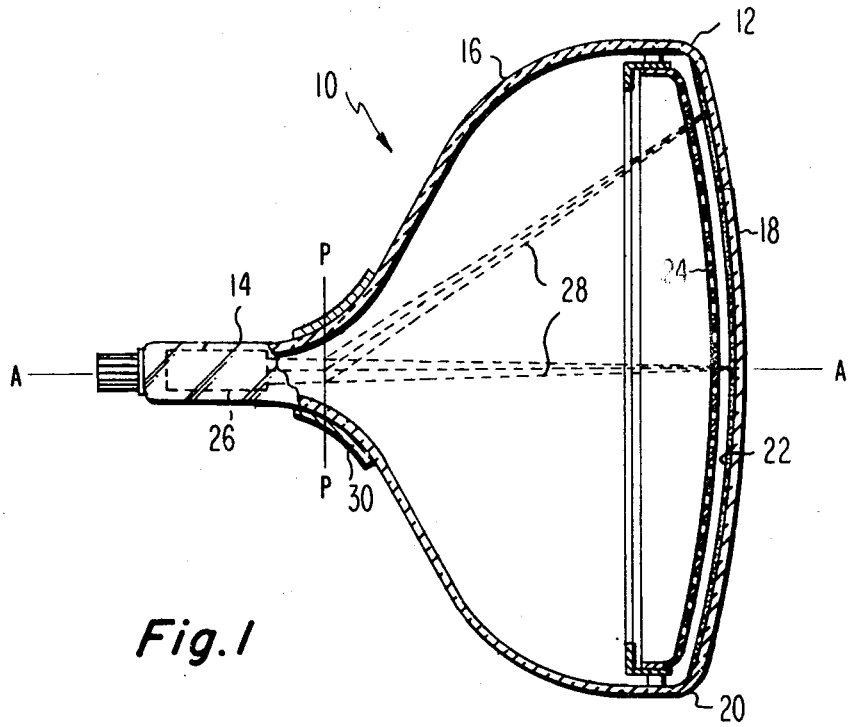
FIG. 1 is a plan view, partly in axial section, of a shadow mask color picture tube embodying the invention.

FIG. 1 is a plan view of a rectangular color picture tube having a glass envelope 10 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30, schematically shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1.

Figure 2:
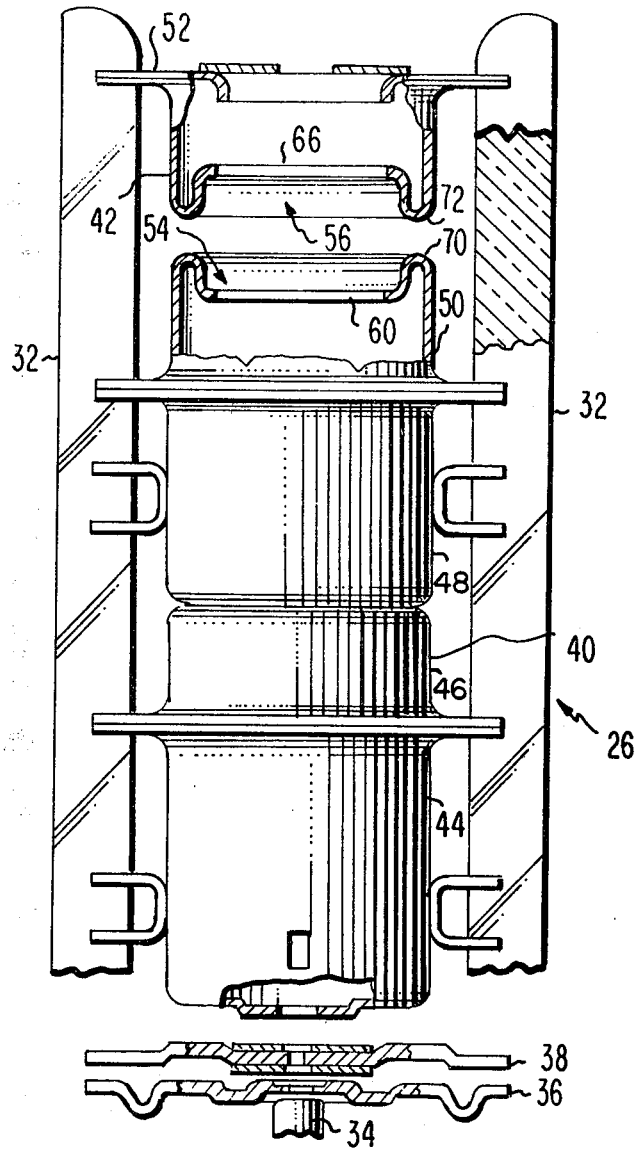
FIG. 2 is a partial axial section view of the electron gun shown in dashed lines in FIG. 1.
Figure 3:
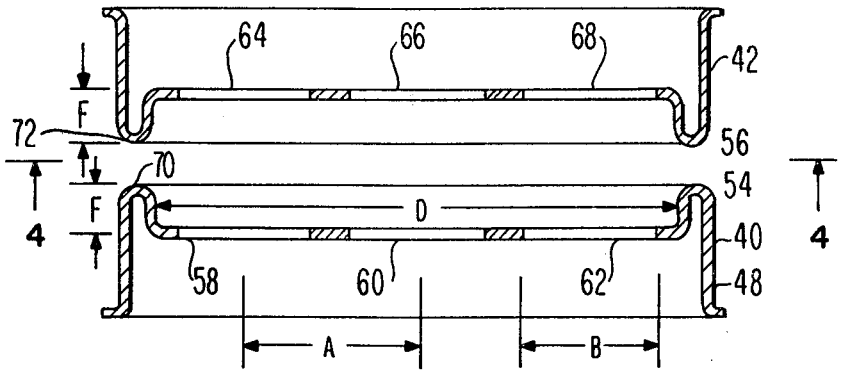
FIG. 3 is an axial sectional view of the G3 and G4 electrodes of the electron gun of FIG. 2.
Figure 4:
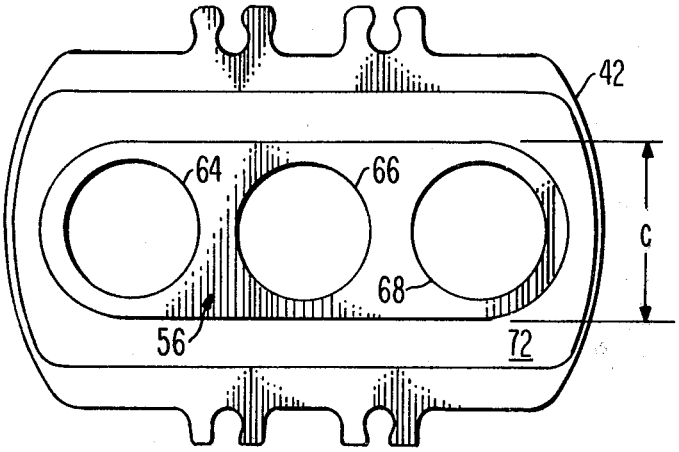
FIG. 4 is a front view of the electron gun of FIG. 2 taken along line 4—4 of FIG. 3.

The details of the electron gun 26 are shown in FIGS. 2 through 4. The electron gun 26 comprises two glass support rods 32 on which the various electrodes are mounted. These electrodes include three equally spaced coplanar cathodes 34 (one for each beam), a control grid or G1 electrode 36, a screen grid or G2 electrode 38, a first accelerating and focusing electrode 40 (G3), and a second accelerating and focusing electrode 42 (G4), spaced along the glass rods 32 in the order named. All of the electrodes following the cathodes have three inline apertures in them to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode also is cup-shaped, but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures 58, 60 and 62 from the portion of the closed end of the G4 electrode 42 that contains three apertures 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42 to each other.

The principal distinguishing features of the electron gun 26 from the electron gun of the aforementioned copending Hughes et al. application are that the facing portions of the G3 and G4 electrodes, 40 and 42, respectively, are identical and are formed without extrusions or lips surrounding their respective apertures 58, 60 and 62 and 64, 66 and 68. Because of this construction, the length or depth of the apertures in these electrodes is equal to the thickness of the material of the electrodes. The advantages of this construction will be discussed hereinafter.

Figure 6:
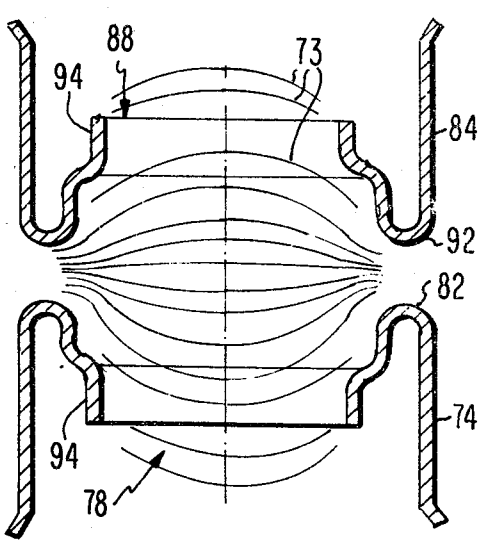
Fig.6 PRIOR ART
FIGS. 5 and 6 are axial sectional top and side views, respectively, of the focusing lens electrodes of a prior art electron gun showing some equipotential lines of the electrostatic focusing lens fields. The view of FIG. 6 is taken at line 6—6 of FIG. 5.
Figure 5:
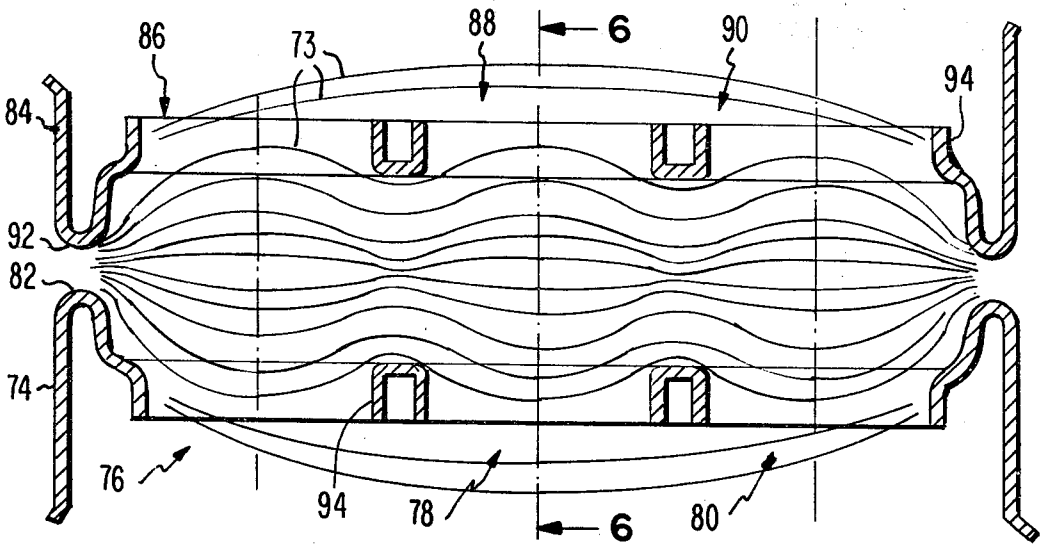
Fig.5 PRIOR ART

The equipotential electrostatic field lines 73 for the main focus lens of an electron gun such as that disclosed in the aforementioned copending Hughes et al. application are shown in the top and side sectional views of FIGS. 5 and 6, respectively. A G3 electrode 74 includes three apertures 76, 78 and 80 which are set back in a recess from a peripheral rim 82. Similarly, a G4 electrode 84 includes three apertures 86, 88 and 90 which are set back in a recess from another peripheral rim 92. The rims 82 and 92 are the closest portions of the two electrodes 74 and 84 to each other. Each aperture in each electrode includes a surrounding peripheral extrusion or lip 94. The purposes of the lips 94 are to confine and shape the equipotential electrostatic field lines at each of the apertures and to reduce penetration of the field lines within the individual electrodes. The field lines at the apertures are curved such that the outer two beams encounter essentially the same type focusing field as does the center beam. With such an electrode structure, two methods have been used to aid in converging the two outer beams with the center beam. In one of these methods, the outer two apertures 86 and 90 in the G4 electrode 84 are offset outwardly from the two outer apertures 76 and 80 in the G3 electrode 74. In another method, the rim spacing of the rim 92 on the G4 electrode 84 is made wider in the inline direction of the beams than the rim spacing of the rim 82 on the G3 electrode 74. In both of these methods, the facing portions of the G3 and G4 electrodes are structurally different.

Figure 8:
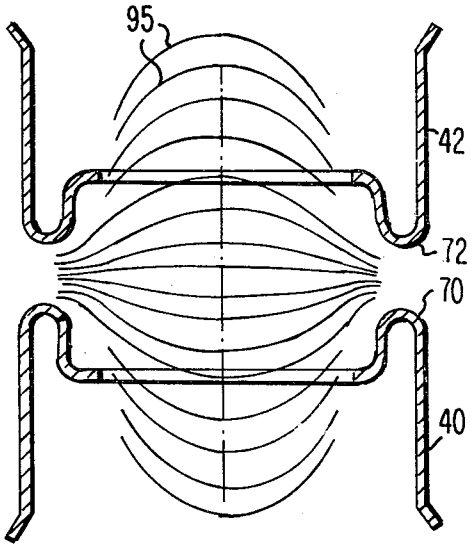
FIGS. 7 and 8 are axial sectional top and side views, respectively, of the focusing lens electrodes of the electron gun of FIG. 2 showing some equipotential lines of electrostatic focusing lens fields. The view of FIG. 8 is taken at line 8—8 of FIG. 7.
Figure 7:
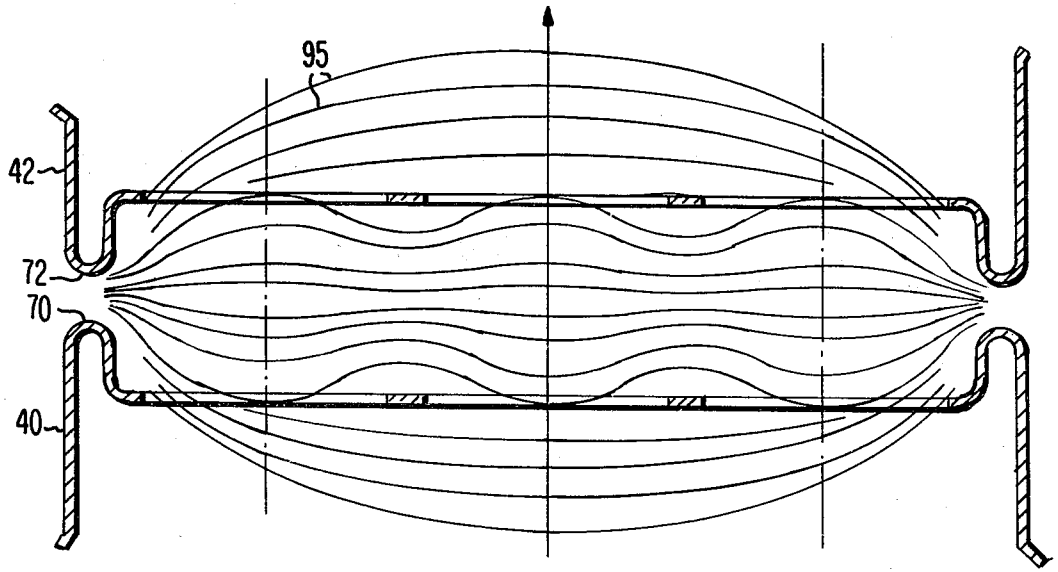

The equipotential electrostatic field lines 95 of the main focus lens of the electron gun 26 are shown in the top and side sectional views of FIGS. 7 and 8, respectively. Because of the absence of extrusions or lips surrounding the apertures of the G3 electrode 40 and the G4 electrode 42, additional smooth continuous field lines extend within the electrode cups behind the apertures. The result of these additional smooth field lines is the formation of a main focusing lens that much closer resembles a single large electrostatic lens than formed by the prior art structure. The two outer electron beams are converged toward the center beam by this larger electrostatic lens since they must pass through the more curved electrostatic field lines. Because of this enhanced converging effect, the facing portions of the G3 and G4 electrodes need not be of different structures, as is necessary in the prior art electron gun, but rather the facing portions of these electrodes may be identical. This has the advantages of reducing the number of differently-shaped parts required to construct an electron gun and of eliminating the chance of reversal of the electrodes during construction.

Some typical dimensions for the electron gun 26 of FIG. 2 are presented in the following table.

TABLE

External diameter of tube neck: 29.00 mm
Internal diameter of tube neck: 24.00 mm
Spacing between G3 and G4 electrodes 40 and 42: 1.27 mm
Center-to-center spacing between adjacent apertures in G3 electrode 40 (A in FIG. 3): 6.60 mm
Inner diameter of apertures 58, 60 and 62 in G3 electrode 40 (B in FIG. 3): 5.44 mm
Spacing between two straight sides of recesses in the electrodes 40 and 42 (C in FIG. 4): 6.99 mm
Width of recess in the G3 and G4 electrodes 40 and 42 (D in FIG. 3): 20.19 mm
Depth of recess in the electrodes 40 and 42 (F in FIG. 3): 1.65 mm In various other inline electron gun embodiments, the depth of the recess in the electrodes 40 and 42 may vary from 1.30 mm to 2.80 mm.

As previously stated, an electron gun, such as described in the Hughes et al. application Ser. No. 201,691, provides only forty percent of the static convergence required. A similar electron gun, modified to incorporate the present invention, provided eighty percent of the static convergence required with no deleterious effect on electron gun performance.

What is claimed is:

1. In a color picture tube having an inline electron gun for generating and directing a plurality of electron beams along coplanar paths toward a screen of said tube, said gun including a main focus lens for focusing said electron beams, the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, the improvement comprising the depths of the apertures in said electrodes being equal to the thickness of material of said electrodes.

2. In a color picture tube having an inline electron gun for generating and directing three electron beams along coplanar paths toward a screen of said tube, said gun including a main focus lens for focusing said electron beams, the main focus lens being formed by two spaced electrode members each having three separate inline apertures therein, each electrode also including a peripheral rim, the peripheral rims of the two electrodes facing each other, the apertured portion of each electrode being within a recess set back from the rim, the improvement comprising the apertured portion of each electrode being flat and being without extrusions around the apertures.

3. In a color picture tube having an inline electron gun for generating and directing a plurality of electron beams along coplanar paths toward a screen of said tube, said gun including a main focus lens for focusing said electron beams, the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, the improvement comprising the facing portions of said two spaced electrodes being identical in shape, and the depths of the apertures in said electrodes being equal to the thickness of material of said electrodes.

* * * * *